United States Patent [19]

Sergev

[11] 4,179,583

[45] Dec. 18, 1979

[54] ELECTRO-MECHANICAL LOW BACKLASH CABLE CONNECTOR

[75] Inventor: Sergius S. Sergev, Ventura, Calif.

[73] Assignee: The United States of America as represented by the Secretary of the Navy, Washington, D.C.

[21] Appl. No.: 883,557

[22] Filed: Mar. 6, 1978

[51] Int. Cl.[2] ..... H01R 5/00; H01R 5/08

[52] U.S. Cl. ..... 174/21 R; 174/94 R; 182/136; 403/298; 403/314

[58] Field of Search ..... 182/136; 174/21 R, 21 JS, 174/84 R, 84 S, 90, 94 R, 94 S, 93; 403/292, 298, 314, 296; 285/176, 383

[56] References Cited

U.S. PATENT DOCUMENTS

| | | | |
|---|---|---|---|
| 561,441 | 6/1896 | Schmidt | 285/176 |
| 1,817,776 | 8/1931 | Side | 285/383 X |
| 1,854,783 | 4/1932 | Cook | 174/84 S |
| 2,264,480 | 12/1941 | Owen | 403/296 |
| 2,648,883 | 8/1953 | Dupre | 174/94 S |
| 3,044,037 | 7/1962 | Honig | 174/93 X |
| 3,384,704 | 5/1968 | Vockroth | 174/90 |

*Primary Examiner*—Roy N. Envall, Jr.

*Attorney, Agent, or Firm*—Richard S. Sciascia; Joseph M. St.Amand; Darrel E. Hollis

[57] ABSTRACT

An electro-mechanical, low backlash cable connector having a plurality of spring washers disposed within a connector housing. A plurality of spacer washers disposed between each pair of spring washers imparts independent operation to each spring washer and translates shear forces from the entering cable to the connector housing. Both the spring washers and the spacer washers are disposed at an inward angle from the connector housing opening. Such angular disposition allows a cable to freely enter the connector housing. However, upon attempting to withdraw the cable, the spring washers bite into the cable thereby preventing its egress.

16 Claims, 17 Drawing Figures

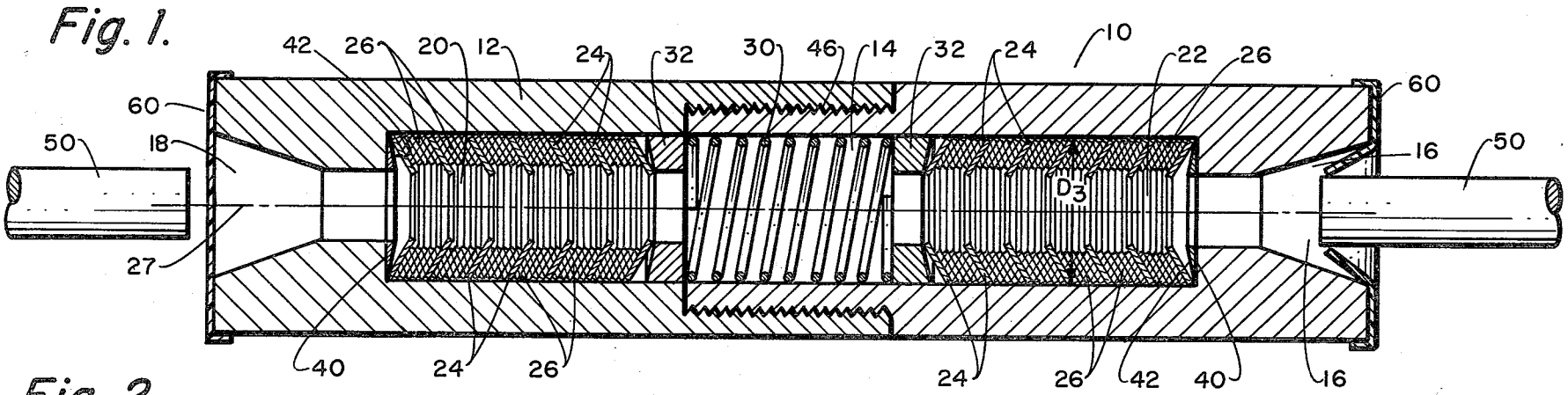
Fig. 1.
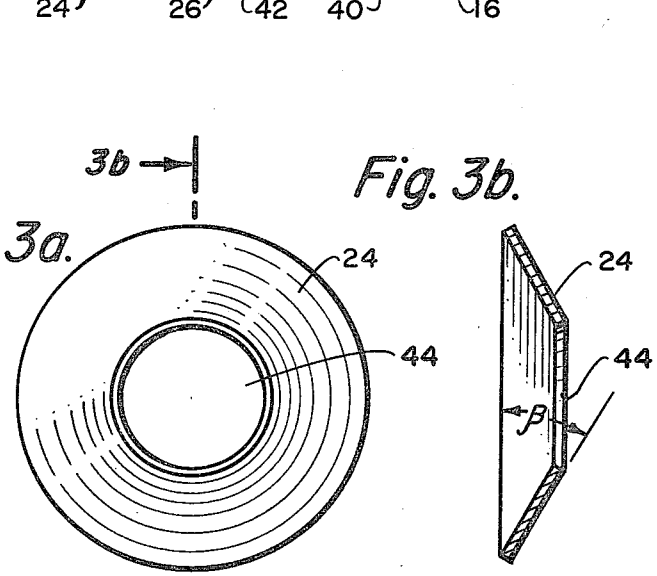
Fig. 3b.
Fig. 3a.
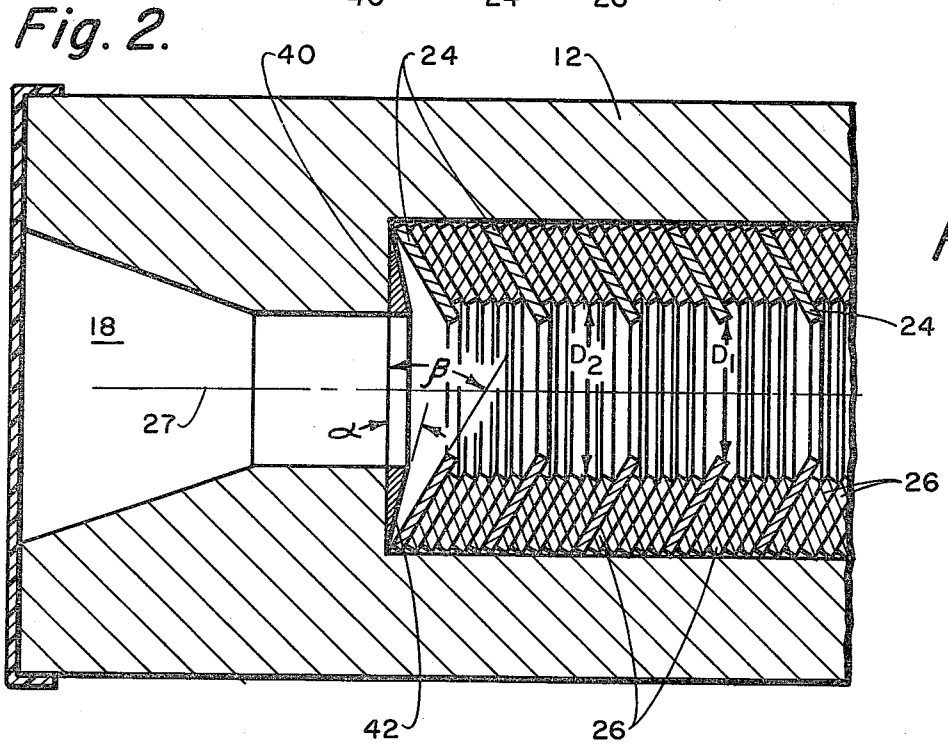
Fig. 2.

ELECTRO-MECHANICAL LOW BACKLASH CABLE CONNECTOR

BACKGROUND OF THE INVENTION

1. Field of the Invention

The present invention relates generally to electro-mechanical low backlash cable connectors and more particularly to such cable connectors that are adapted for connecting cables.

2. Description of the Prior Art

There are numerous prior art coupling devices utilizing springs or other devices disposed within a housing such that a tube or other insertion member inserted thereinto will be engaged by the springs and thereby prevented from being withdrawn from the housing. However, such devices have several drawbacks which it is an object of the present invention to overcome. These prior art devices have no means by which to maintain the springs inclined inwardly from the openings of their housings resulting in a loss of grip when large tension forces are applied to the insertion member. In addition, these prior art devices do not provide a means for aligning the insertion member prior to entering the housing thereby limiting their operability. Nor do they provide a rupturable diaphragm covering the housing opening so that the housing chamber may be oil filled thereby limiting their usefulness to clean environments.

SUMMARY OF THE INVENTION

The present invention overcomes the disadvantages and limitations of the prior art by providing an improved electro-mechanical low backlash cable connector. The present invention utilizes a series of spring washers disposed within a chamber of a connector housing. A series of spacer washers disposed between each pair of spring washers serves to impart independent operation to each spring washer and to translate shear forces from an entering cable to the connector housing. Both the spring washers and the spacer washers are disposed at an inwardly inclined angle from the connector housing opening. Such angular disposition allows a cable to freely enter the connector housing. However, upon attempting to withdraw the cable the spring washers bite into the cable thereby preventing its egress. The outside diameter of the spring washers is slightly smaller than the inside diameter of the chamber so that no radial forces are exerted on the chamber by the spring washers. In addition, a body thrust ring maintains the spring washers inwardly inclined. A rupturable diaphragm or seal covers the housing opening so that the chamber may be filled with a suitable fluid thereby preventing foreign matter such as water from entering the splice. A sleeve is utilized to align stranded cables which may be bent or otherwise deformed prior to splicing.

Accordingly, it is an object of the present invention to provide an electrical connector as well as a mechanical connector.

Another object of the present invention is to provide a cable connector having low backlash.

A still further object of the present invention is to provide an electro mechanical cable connector which is reliable in operation and inexpensive to manufacture.

A still further object of the present invention is to eliminate radial forces.

Other objects and further scope of applicability of the present invention will become apparent from the detailed description given hereinafter. The detailed description indicates the preferred embodiments of the invention and is given by way of illustration only since various changes and modifications within the spirit and scope of the invention will become apparent to those skilled in the art from this detailed description when considered in connection with the accompanying drawings and which like reference numerals designate like parts throughout the figures thereof and wherein.

It should be understood that the foregoing abstract of the disclosure is for the purpose of providing a non-legal brief statement to serve as a search scanning tool for scientists, engineers and researchers and is not intended to limit the scope of the invention as disclosed herein. Nor is it intended that it should be used in interpreting or in anyway limiting the scope or fair meansing of the appended claims.

BRIEF DESCRIPTION OF THE DRAWINGS

FIG. 1 is a cross-sectional view of one embodiment of the present invention.

FIG. 2 is a cross-sectional view of a portion of the embodiment shown in FIG. 1.

FIGS. 3*a* and 3*b* are a front view and a side view respectively of the spring washers utilized in the embodiment of FIG. 1.

DETAILED DESCRIPTION OF THE PREFERRED EMBODIMENTS

Figure 4A:
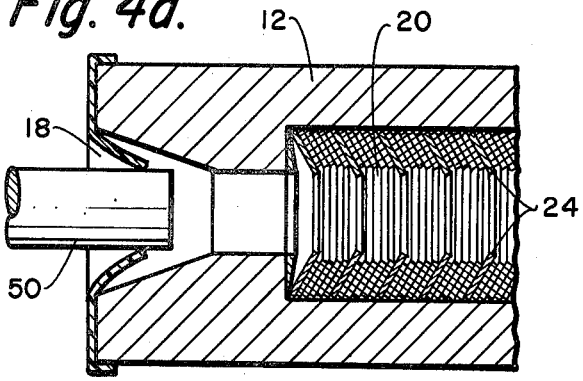
FIGS. 4*a* and 4*b* illustrate the operation of the embodiment shown in FIG. 1.

FIG. 1 is a cross-sectional view of one embodiment 10 of the present invention. Cable connector housing 12 having a single bore or chamber 14 therein consists of two halves which are screw threaded together. Cable connector 12 contains openings 16 and 18 communicating with chamber 14.

Chamber 14 is divided into two subchambers 20 and 22. Disposed within subchambers 20 and 22 are a plurality of spring washers 24 which are inwardly inclined from respective openings 18 and 16 with respect to a plane perpendicular to longitudinal axis 27. A plurality of spacer washers 26 separate each spring washer 24 from its adjacent spring washer 24 so that each spring washer 24 acts independently of the other spring washers 24 within subchambers 20 and 22. This independent action insures that one malfunctioning spring washer 24 will not affect neighboring spring washer 24's performance.

Spring 30 and endplate assembly rings 32 exert a force on spring washers 24 thereby biasing spring washers 24 in position prior to the insertion of insertion members or cables 50 into chambers 20 and 22.

Thrust body ring 40 disposed adjacent openings 18 and 16 provides an inwardly inclined angle surface 42 for maintaining spring washers 24 inwardly inclined thereby preventing spring washers 24 from snapping through center and losing their grip. It is noted that body thrust rings 40 may be molded integral with housing 12.

In operation, a prepared cable end 50 (electrical insulation may be removed) is inserted into connector housing 12. Metal spring washers 24 allow cable 50 to ingress into chambers 20 and 22 but bite into cable 50 as cable 50 is tensioned—FIG. 4*b*.

Now turning to FIGS. 3*a* and 3*b*, a front and side view of a single spring washer 24 is illustrated. The spring washer 24 is dished at an angle $\beta$ with the washer hole 44 ($d_1$) dimensioned to be slightly smaller than the diameter of cable 50. Spring washers 24 may be selectively heat treated so that the edge is harder than cable 50. The body of spring washer 24 is springy so that cable 50 may be inserted. The hardened edge allows the spring washers 24 to bite into cable 50. In addition, the washers 24 and 26, body thrust ring 40 and body threads 46 may be plated with silver or other electrically conductive material to improve electrical contact. The electrical contact between the two spliced cables 50 is through connector housing 12.

Now turning to FIG. 2, body thrust ring 40 and spring washers 24 are shown in greater detail. It is noted that the surface 42 of body thrust ring 40 is angled at angle $\alpha$ which is slightly smaller than the angle $\beta$ of spring washer 24. This allows the spring washer 24 to deflect but prevents it from snapping through center and losing its grip on cable 50 when cable 50 is tensioned. It is noted that angles $\alpha$ and $\beta$ are measured with respect to a plane perpendicular to longitudinal axis 27 of chamber or bore 14.

The depth of the dish of spring washer 24 is determined by experiment for optimal holding capability. When the holding strength of one washer is determined, the holding strength of the connector can be approximated by multiplying the individual strength by the number of spring washers 24 utilized. Of course, actual strength should be determined by direct experiment. It is noted that the diameter $D_1$ of spring washers 24 should be slightly less than the cable diameter whereas the diameter of $D_2$ of spacer washers 26 should be slightly greater than the cable diameter.

Spacer washers 26 transmit the load from each spring washer 24 to the body thrust surface 42. Spacer washers 26 should be disposed so several are placed between adjacent spring washers 24. Spacer washers 26 may be springy or they may be made of resilient metal which can be flexed or deformed as spring washers 24 bite cable 50. The hole or inside diameter $D_2$ of spacer washers 26 should be slightly larger than the cable diameter so that spacer washers 26 will not interfere with the body action of the spring washer 24. The inside diameter $D_3$ of chamber or bore 14 within subchambers 20 and 22 is dimensioned to be slightly larger than the outside diameter of spring washers 24 and spacer washers 26 so that no radial forces are exerted on housing 12 by the spring washers 24 or the spacer washers 26.

The geometry and action of spring washers 24 minimizes backlash. The connector 10 does not have to be set since it is self-actuating and will set itself when cable 50 is tensioned. The splice can be unmade by separating the connector housing halves and removing washers 24 and 26 from cable 50. No large radial forces are developed by the clamping mechanism so the cable connector housing may be of minimal diameter. The spring washers 24 are particularly suited to a stranded cable 50 since it will completely contain the individual strands of cable 50. Some washers are slotted thereby allowing individual strands to enter the slots thus leaving the main wire bundle. This effectively decreases the bundle diameter and the washer diameter would be too large to contact the bundle uniformly.

A seal or diaphragm 60 is provided over opening 18 thereby allowing subchamber 20 to be fluid filled with a volume of oil suitable for electrical splices. Inserting cable 50 into subchamber 20 punctures diaphragm or seal 60 allowing the electrical connection to be bathed in oil. In addition, seal 60 prevents foreign matter such as water from entering subchamber 20 prior to the insertion of cable 50 therein. It is noted that a seal may identically cover opening 16 of subchamber 22.

It is noted that housing 12, and washers 24 and 26 may be fabricated from a metal or other electrically conductive material where an electrical splice or connection is desired. However, the present invention may be utilized to provide a non-electrical splice in which case a non-metallic material may be utilized for fabrication.

Figure 4B:
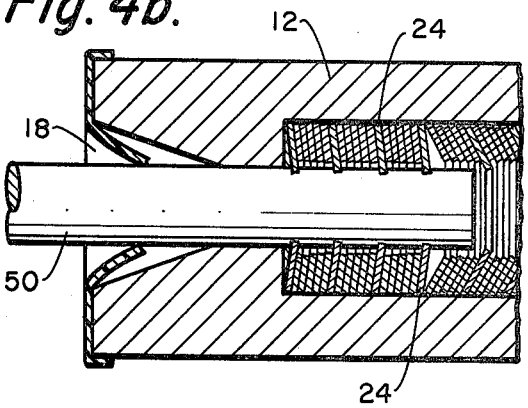

Now turning to FIGS. 4*a* and 4*b*, the operation of the embodiment shown in FIG. 1 is illustrated. In FIG. 4*a*, cable 50 stands ready to be inserted through opening 18 into subchamber 20. While in FIG. 4*b* cable 50 has been tensioned and washers 24 are biting thereinto.

Figure 5A:
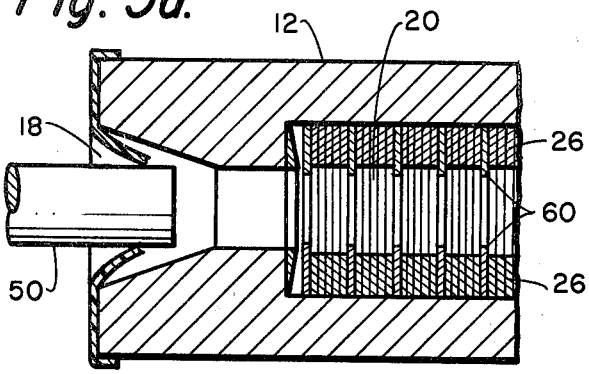
FIGS. 5*a* and 5*b* illustrate the operation of an alternative embodiment of the present invention.
Figure 5B:
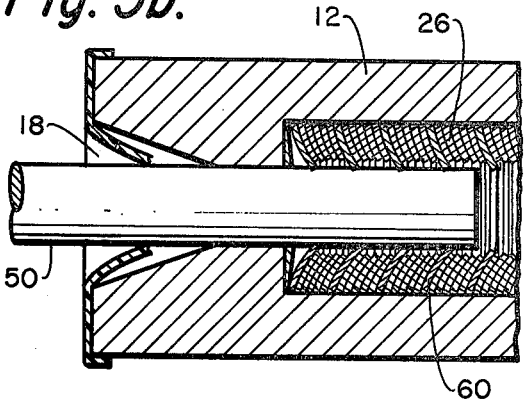
Figure 6A:
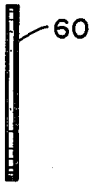
FIGS. 6*a* and 6*b* are a side view and front view of a slotted washer utilized in the embodiment of FIGS. 5*a* and 5*b*.
Figure 6B:
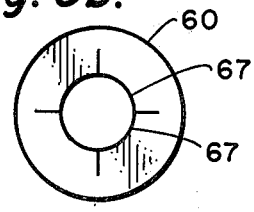

Now turning to FIGS. 5*a* and 5*b*, an alternative embodiment employing the spring washers 60 shown in FIGS. 6*a* and 6*b* is illustrated. As shown in FIGS. 6*a* and 6*b*, washers 60 are slotted or provided with slits. When cable 50 is pushed into housing 12, the fingers 62 formed by the slits deflect and allow the cable to enter. But when the cable is tensioned the fingers 62 bite into the cable making the splice. Fingers 62 allow for some variation in the cable diameter and accommodate some surface irregularities. Again the body edges of washers 60 are hardened and the body is springy. Again spacer washers 26 may be utilized to separate spring washers 60 thereby providing independent action to each washer 60.

Figure 7A:
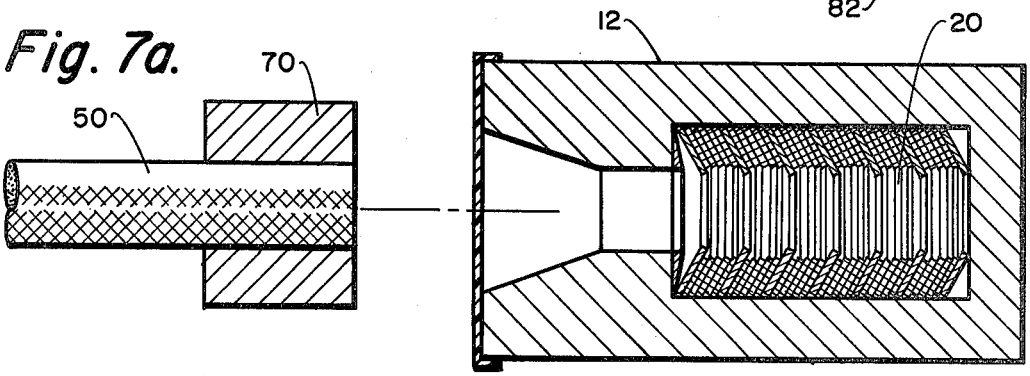
FIGS. 7*a* and 7*b* illustrate the operation of a sleeve for aligning a stranded cable prior to entering the chamber.
Figure 7B:
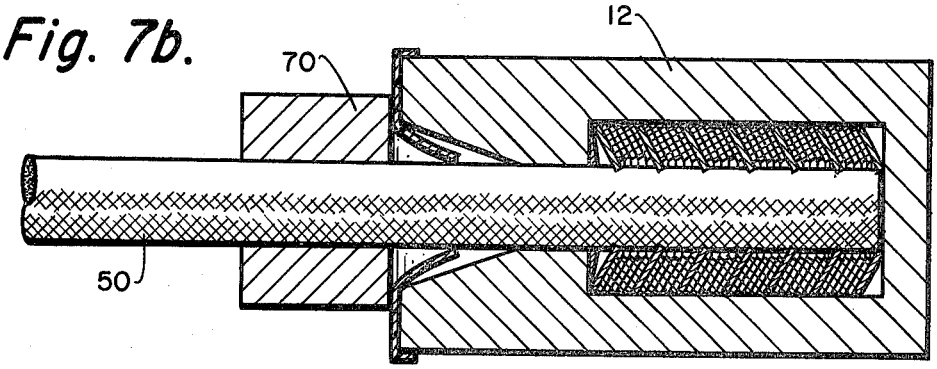

Now turning to FIGS. 7*a* and 7*b*, cable 50 is shown surrounded by sleeve 70. Sleeve 70 straightens any bends or other irregularities within a stranded cable such as cable 50 prior to insertion of cable 50 into subchamber 20.

Figure 8:
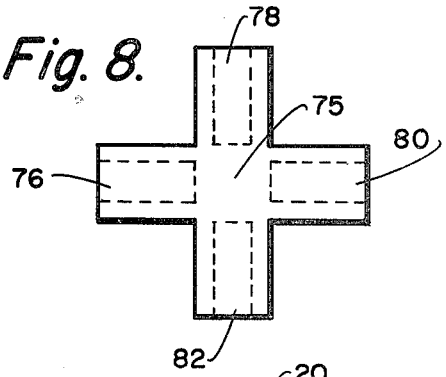
FIG. 8 illustrates the top view of a connector housing having four chambers therein for providing interconnection of four cables.

Now turning to FIG. 8, a connector housing 75 is shown having therein chambers 76, 78, 80 and 82 whereby four cables 50 may be connected or spliced together.

Figure 9A:
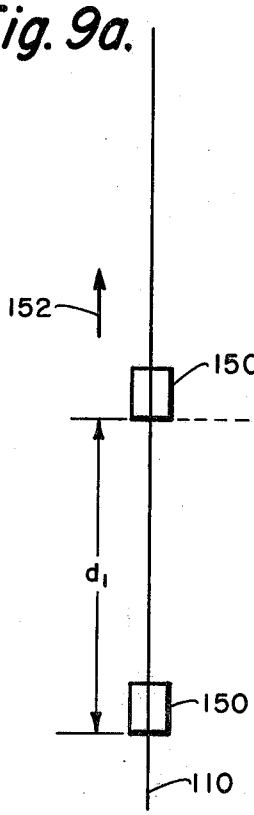
FIGS. 9*a*, 9*b* and 9*c* illustrate a method for utilizing the embodiment of FIG. 10 to climb a cable.
Figure 9B:
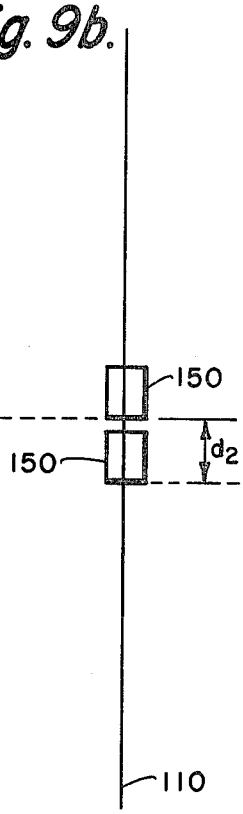
Figure 9C:
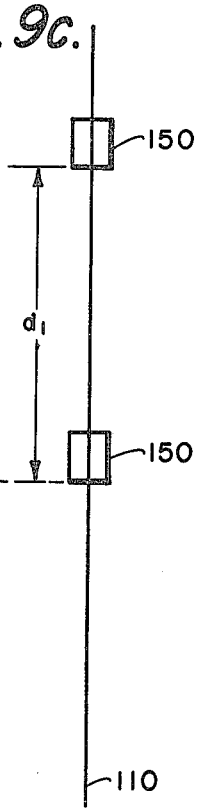
Figure 10:
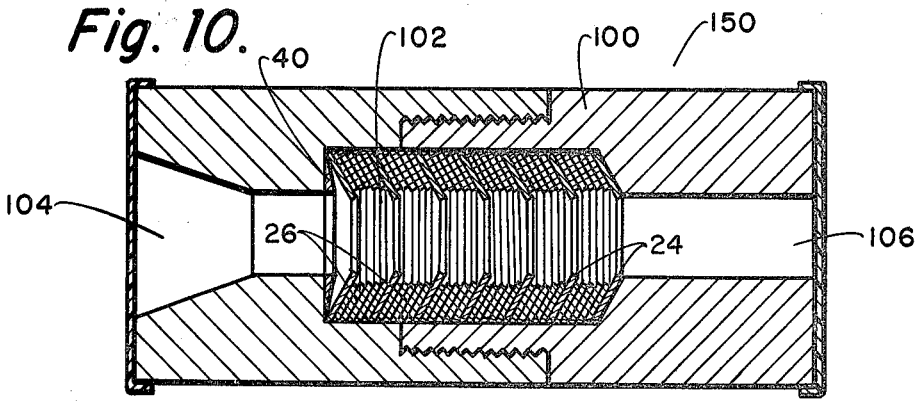
FIG. 10 is a cross-sectional view illustrating an alternative embodiment of the present invention.

FIG. 10 illustrates an alternative embodiment 150 of the present invention. The embodiment of FIG. 10 includes a housing 100 and having a chamber 102 formed therein. Disposed within chamber 102 are a plurality of spring washers 24 spaced apart by a plurality of spacer washers 26. Spacer washers 26 are inclined inward from opening 104 towards opening 106. A thrust ring 40 is provided to prevent spring washers 24 from snapping through center and losing their bite on a cable inserted therein. The embodiment shown in FIG. 10 is utilized to climb cable 110 as shown in FIGS. 9*a*, 9*b* and 9*c*. Initially a pair of cable grabbers 150 are inserted over cable 110 such that each cable grabber 150 may move in the direction of arrow 152 only. As shown in FIG. 9*a*, initially the two cable grabbers 150 are separated by distance $d_1$. Then the lower cable grabber 150 is moved upwards along cable 110 to a distance $d_2$ from the upper cable grabber 150. Distance $d_2$ is smaller than distance $d_1$. Next turning to FIG. 9*c*, upper cable grabber 150 is moved upwards from lower cable grabber 150, a distance $d_1$. Next lower cable grabber 150 is moved upwards adjacent upper cable grabber 150 until upper cable grabber 150 is separated from lower cable grabber 150 by distance $d_1$ as shown in FIG. 9*b*. These two steps are repeated as the two cable grabbers are moved or bootstrapped up cable 110.

Therefore many modifications and embodiments and embodiments of this specific invention will readily come to mind to one skilled in the art having the benefit of the teachings presented in the foregoing description and the accompanying drawings of the subject invention and hence it is to be understood that the invention is not limited thereto and that such modification, etc., are intended to be included within the scope of the appended claims.

What is claimed is:

1. An electro mechanical connector comprising:

a. a housing containing a plurality of chambers respectively having a plurality of openings with each opening being adapted to receive an insertion member;

b. gripping means inwardly inclined within each said chamber and engageable between said insertion member and said housing for preventing withdrawal of said insertion member, said gripping means including a plurality of aligned, inwardly biased spring washers for engaging said insertion member and spacer means disposed between each spring washer for maintaining independent actuation of each said spring washer; and c. means adjacent each said chamber opening for maintaining said gripping means inwardly inclined.

2. The apparatus of claim 1 further including:

a. a volume of fluid contained within each said chamber; and b. a plurality of rupturable seals respectively disposed adjacent each said opening for retaining said fluid within each said chamber.

3. The apparatus of claim 2 wherein said volume of fluid includes an oil.

4. The apparatus of claim 3 wherein said oil includes an oil suitable for electrical splices.

5. The apparatus of claim 1 further including means for aligning said insertion members prior to entry into said chambers.

6. The apparatus of claim 5 wherein said aligning means includes a plurality of sleeves each having a bore therethrough, through which said insertion members respectively pass prior to entry into said chambers.

7. The apparatus of claim 1 wherein said spring washers include dished washers.

8. The apparatus of claim 1 wherein said spring washers include fingered washers.

9. The apparatus of claim 1 wherein each said spring washer is selectively hardened along that portion engaging said insertion member.

10. The apparatus of claim 1 wherein each said spring washer is plated to improve electrical contact between said housing and said insertion member.

11. The apparatus of claim 9 wherein each said spring washer is silver plated.

12. The apparatus of claim 1 wherein said spacer means includes a plurality of spacer washers.

13. The apparatus of claim 1 wherein said maintaining means includes a thrust member adjacent said gripping means, said thrust member having an inwardly inclined surface.

14. The apparatus of claim 13 wherein said thrust member is inwardly inclined at an angle smaller than the angle of inward inclination of said gripping means such that said gripping means are maintained inwardly inclined, said thrust member abutting said gripping means.

15. The apparatus of claim 13 wherein said thrust member is integral with said housing.

16. A unidirectional cable grabbing device being movable with respect to a cable in one direction only comprising:

a. a housing containing a chamber for passage of a cable therethrough;

b. gripping means inwardly inclined within said chamber and engageable between said cable and said housing for allowing passage of said cable through said chamber in one direction only, said gripping means including a plurality of aligned, inwardly biased spring washers for engaging said cable and spacer means disposed between each spring washer; and c. a thrust member adjacent the chamber opening having an inwardly inclined surface, said thrust member being inwardly inclined at an angle smaller than the angle of inward inclination of said gripping means such that said gripping means are maintained inwardly inclined.

* * * * *